United States Patent [19]

Pringle

[11] Patent Number: 4,601,342

[45] Date of Patent: Jul. 22, 1986

[54] WELL INJECTION VALVE WITH RETRACTABLE CHOKE

[75] Inventor: Ronald E. Pringle, Houston, Tex.

[73] Assignee: Camco, Incorporated, Houston, Tex.

[21] Appl. No.: 710,360

[22] Filed: Mar. 11, 1985

[51] Int. Cl.[4] ..... E21B 43/12

[52] U.S. Cl. ..... 166/323; 166/319

[58] Field of Search ..... 166/319, 320, 321, 322, 166/325, 323

[56] References Cited

U.S. PATENT DOCUMENTS

| | | | |
|---|---|---|---|
| 2,162,578 | 6/1939 | Hacker | 166/325 |
| 3,743,015 | 7/1973 | Mott | 166/323 |
| 4,215,748 | 8/1980 | Pace et al. | 166/323 |

OTHER PUBLICATIONS

Camco, Incorporated 1980–1981 General Equipment Catalog (pp. 1370–1371).

*Primary Examiner*—Stephen J. Novosad
*Assistant Examiner*—William P. Neuder
*Attorney, Agent, or Firm*—Fulbright & Jaworski

[57] ABSTRACT

An injection valve for use in a well conduit for injecting fluids into the conduit having a housing with a bore and a valve closure member in the bore moving between open and closed positions. A flow tube is telescopically movable in the housing for controlling the movement of the valve closure member and moves downwardly to open the valve closure member and is biased upwardly for closing the valve closure member. A variable, radially retractable choke is connected to the flow tube and extends into the bore for moving the flow tube downwardly in response to fluid injection, but contracts to allow passage of well tools through the valve. The flow tube may include a no-go shoulder and a releasable lockout may be provided between the flow tube and the housing.

5 Claims, 7 Drawing Figures

Fig. 1
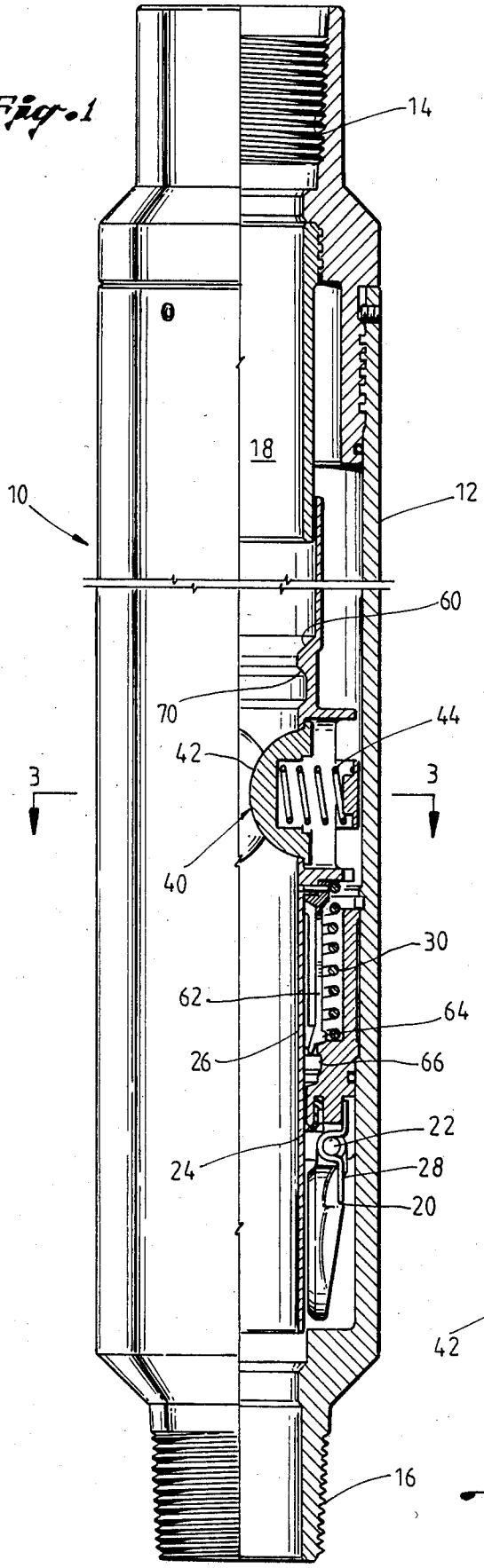
Fig. 2
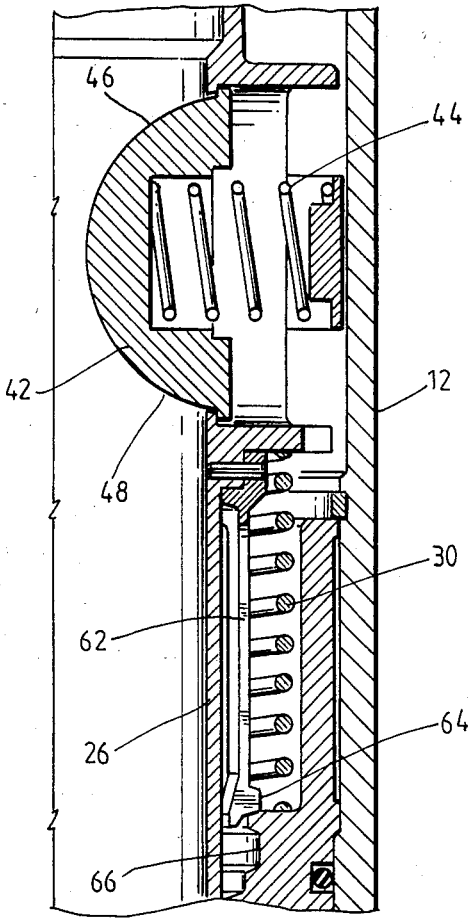
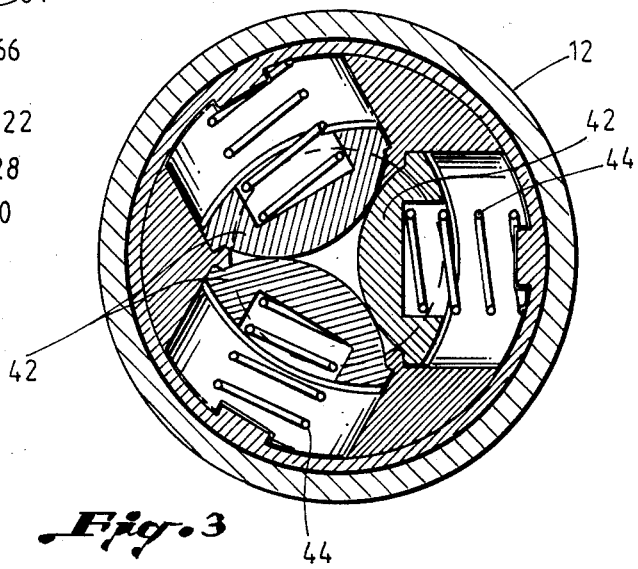
Fig. 3

WELL INJECTION VALVE WITH RETRACTABLE CHOKE

BACKGROUND OF THE INVENTION

It is known to utilize an injection valve in wells in which fluids are injected for various purposes such as secondary recovery, fluid disposal, or fluid storage. Valves, such as the series "A" sold by Camco, Incorporated, and described on pages 1370 and 1371 of the Camco 1980–1981 General Equipment Catalog utilize a spring loaded normally closed flow check valve which utilizes selectively sized chokes which are activated by injection fluid forces to open the valve. However, the chokes extend into the internal bore of the valve reducing the internal size of the valve bore. These restrictions prevent the passage of well tools therethrough. Therefore, in order to conduct work below the valve, the injection valve must first be pulled. However, it is desirable to perform work below the valve such as bottom hole surveys including temperature, pressure, and injection flow rate measurements without pulling the injection valve.

The present invention is directed to a well injection valve having a retractable choke to provide full bore capabilities for running wire line tools therethrough as the choke opens, but allows the choke to contract and operate the valve with a minimum injection

SUMMARY

The present invention is directed to an injection valve for use in a well conduit having a housing with a bore and a valve closure member in the bore moving between open and closed positions. A flow tube is telescopically movable in the housing for controlling the movement of the valve closure member and is biased in a direction for allowing the valve closure member to close. An expandable and contractable restriction is connected to the flow tube and extends into the bore for moving the flow tube to the open position in response to injection fluid, but expands to allow the passage of well tools through the valve.

A still further object of the present invention is wherein the restriction includes a plurality of segments movable into and out of the bore and biasing means yieldably urging the segments into the bore.

Yet a further object is wherein the segments include rounded upper and lower surfaces for allowing the passage of well tools. In one embodiment, the segments may include spherical surfaces extending into the bore.

A still further object is wherein a no-go shoulder is provided on the flow tube and releasable lock out means is provided between the flow tube and the housing for locking the flow tube and valve in the open position.

Still a further object of the present invention is the provision of segments which are pie-shaped in cross section for more fully closing the bore to provide an increased opening force and allowing the use of a maximum biasing force to close the valve.

Still a further object of the present invention is the provision of a variable, and radially retractable choke connected to the flow tube and extending into the bore for moving the flow tube downwardly in response to downward fluid injection in the bore but contracting to allow the passage of well tools through the valve.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 1 an elevational view, in cross section, of the injection valve of the present invention, FIG. 2 is an enlarged fragmentary cross-sectional view of the apparatus of FIG. 1, FIG. 3 is a cross-sectional view, taken along the line 3—3 of FIG. 1 showing the choke in the controlled position.

DESCRIPTION OF THE PREFERRED EMBODIMENTS

Figure 4:
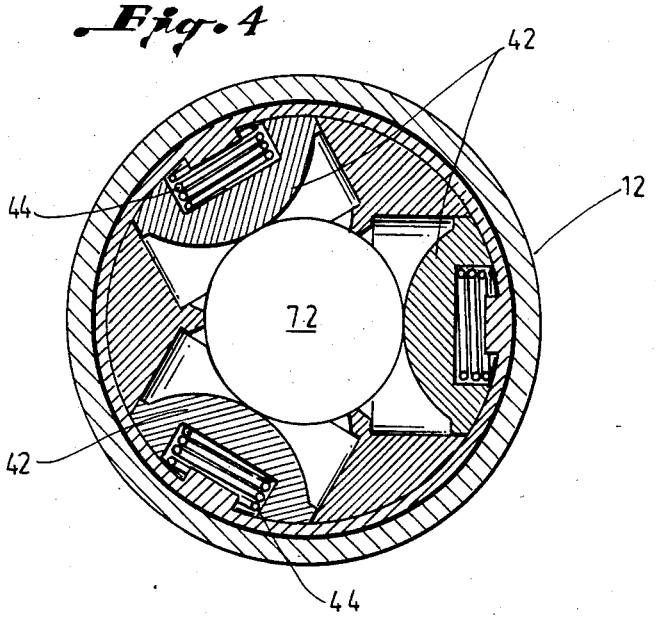
FIG. 4 is a cross-sectional view similar to FIG. 3 showing a well tool passing through the retractable choke of the present invention.
Figure 5:
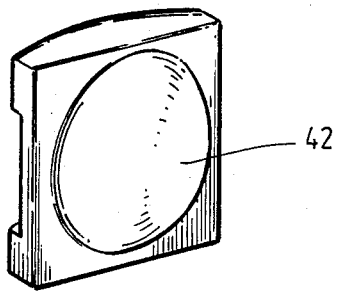
FIG. 5 is a perspective view of one of the choke segments of the embodiment of FIGS. 1–4.

The present injection valve will be described, for purpose of illustration only, as a tubing retrievable type valve using a flapper type closure member, it is to be understood that the present injection valve may be other types of valves and may utilize different valve closure members. However, the valve is particularly useful as a tubing retrievable type valve since it will provide full open bore capability.

Referring now to the drawings, particularly FIG. 1, the reference numeral 10 generally indicates the fluid injection valve of the present invention and includes a housing 12 having upper connecting means such as threads 14 and lower connecting means such as threads 16 for connecting the valve 10 in a well tubing string.

The housing 12 includes a bore 18 and a valve closure member 20 positioned to open and close the bore 18 for allowing or preventing the upward flow of fluids therethrough. The valve closure member 20 is connected to a pivot 22 for moving from the open position as best seen in FIG. 1 to a closed position seating on a valve seat 24. A flow tube 26 is telescopically movable in the housing 12 and is adapted to move downwardly through the valve seat 24 and open the valve closure member 20. When the flow tube 26 is moved upwardly beyond the seat 24, the valve closure member 20 will move inwardly and seat on the valve seat 24 by the action of a spring 28. Biasing means such as a spring 30 is provided for yieldably urging the flow tube 26 upwardly for closing the valve closure member 20.

It is known to utilize such a valve having a flow restriction such as a fixed choke connected to the flow tube 26 to create a force on the flow tube 26 as fluid is injected down the bore 18 to move the flow tube 26 downwardly and open the valve closure member 20. As soon as fluid injection ceases, the flow tube is moved upwardly by the spring 30 and allows the valve closure member 20 to swing to the closed position. Injection valves are used in wells for various purposes such as when fluids are injected into the well for the purpose of secondary recovery, disposal, or fluid storage.

However, it is frequently desirable to run well tools downwardly through the valve 10 to perform additional functions such as to conduct bottom hole surveys including temperature, pressure and injection rate measurements. To perform these operations in the case of a retrievable valve, the valve must be first pulled because the choke extends into the bore 18 and prevents the passage of well tools. Obviously, in the case of a valve 10 which is connected in the tubing string, the valve cannot be pulled and therefore such valves cannot be used.

The present invention is directed to providing an expandable and contraction restriction means generally indicated by the reference numeral 40 which extends into the bore 18 for creating a pressure differential as injection fluid passes downwardly for moving the flow tube 26 to the open position in response to the injection fluid, while at the same time allowing the restriction 40 to retract and allow the passage of well tools through the valve 10. The expandable and contractable restriction 40 may include a plurality of radially movable segments 42 connected to the flow tube 26 which are biased inwardly into the bore 18 by biasing means such as springs 44. While the number of the segments 42 may be any suitable number, they are shown as three segments 42 radially positioned about the bore 18. The segments 42 include rounded upper surfaces 46 and rounded lower surfaces 48 whereby well tools 72 (FIG. 4) may contact the segments 42 while moving downwardly or upwardly to push the segments 42 outwardly away from the bore 18 for allowing the passage of the well tools. This allows the present valve 10 to have the capability of providing a full open bore 18 for passage of well tools. In the preferred embodiment of the present invention as shown in FIGS. 1–5 the segments 42 comprise spherical surfaces.

As shown in FIG. 3, the rounded segments 42 do not completely close the bore 18 when they are in their fully extended position contacting each other, but leave a space 50. While some injection fluids will flow downwardly through the space 50 the differential force across the segments 42 should be sufficient to allow the valve to operate and move to the open position with a minimum flow, such as 100 barrels of fluid per day. In the event that the flow rate increases to a much higher value, the flow rate itself may expand the segments 42 outwardly to increase the size of the opening 50 thereby more easily increasing the fluid flow through the bore 18, but still providing a sufficient differential force across the restriction 42 to maintain the valve 10 in the open position.

Figure 6:
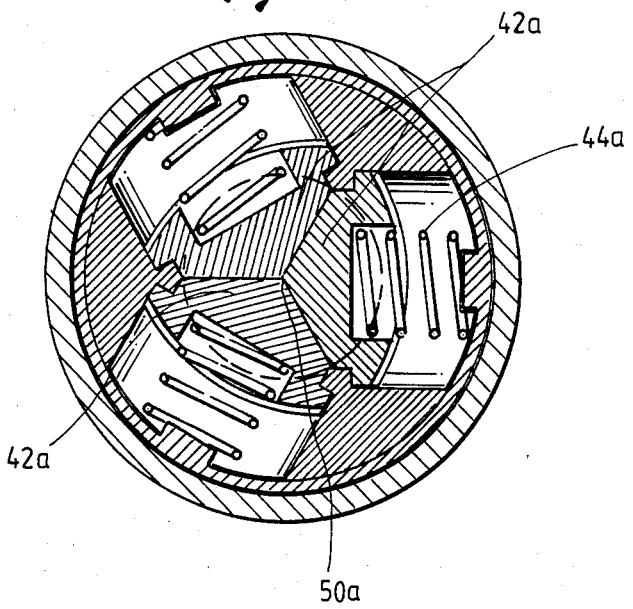
FIG. 6 is a cross-sectional view of another embodiment of the choke of the present invention.
Figure 7:
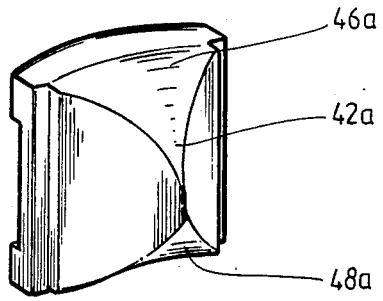
FIG. 7 is a perspective view of one of the choke segments of the embodiment of FIG. 6.

However, it is desirable to utilize a maximum force for the spring 30 to insure upward movement of the flow tube 26 and closure of the valve closure member 20. Therefore, in some instances it may be desirable to provide a configuration of the expandable and contractable restriction 40 to more completely close off the space 50. Therefore another embodiment with a greater radial restriction may be provided, as best seen in FIGS. 6–7 wherein like numbers refer to like parts of FIGS. 1–5 with the addition of the suffix "a". Thus the restriction 40*a* may include three segments 42*a* which are basically pie-shaped in cross section to more completely engage and reduce the size of the opening 50*a*. However, it is to be noted that the segments 42*a* still include rounded upper 46*a* and lower 48*a* surfaces for engagement by well tools for expanding the segments 42*a* out of the bore 18.

Other and further configurations of the segments 42 may be made to provide a variable and radially retractable and expandable choke such as a plurality of longitudinally extending bow springs which are fixed at either and but extend into the bore 18 and are retractible when engaged by well tools.

While the valve 10 may be held in the open position by a well tool moving downhole, it is preferable to provide a releasable lockout so the valve 10 may be releasably held in the open position while doing work in the tubing below the valve 10. Thus, referring to FIG. 1, a no-go shoulder 60 is provided for mechanically moving the flow tube 26 downwardly to open the valve closure member 20. Downward movement of the flow tube 26 beyond its normal open position causes releasable locking means such as a plurality of collet fingers 62 (FIGS. 1 and 2) having a latch 64 to move downwardly whereby the latch 64 engages a recess 66 on the housing 12 for releasably holding the valve 10 in the open position. In addition, the valve includes a downwardly extending shoulder 70 for engagement by a tool for releasing the collet lock 64 from the recess 66 by upward movement of the shoulder 70 and flow tube 26. Therefore, a well tool 72 (FIG. 4) can move down the well bore, engage the no-go 60 for opening the valve closure member 20, and the tool 72 may depress the segments 42 thereby moving through the bore 18 to below the valve 10. On upward movement a well tool may then again move past the rounded segments 42 and a suitable tool provided to engage the shoulder 70 to reactivate the valve 10.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts may be made without departing from the spirit of the invention and the scope of the appended claims.

What is claimed is:

1. An injection valve for use in a well conduit comprising, a housing having a bore, a valve closure member in the bore moving between open and closed positions, a flow tube telescopically movable in the housing for controlling the movement of the valve closure member, means for biasing the flow tube in a direction for allowing the valve closure member to move to the closed position, an expandable and contractible fluid restriction connected to the flow tube and extending into the bore for moving the flow tube to the open position in response to injection fluid, but allowing the passage of well tools through the valve, said restriction contractible in response to fluid flow, said restriction includes, a plurality of segments movable into and out of said bore, and biasing means yieldably urging said segments into said bore, a no-go shoulder on the flow tube, and releasable lockout means between the flow tube and the housing for locking the flow tube and valve in the open position.

2. The apparatus of claim 1 wherein the segments are pie shaped in cross section.

3. The apparatus of claim 1 wherein the means biasing said segments are springs, and said segments are expanded inwardly into contact with each other by said springs.

4. The apparatus of claim 1 wherein said segments include, spherical surfaces extending into the bore.

5. An injection valve for use in a well conduit comprising, a housing having a bore a valve closure member in the bore moving between open and closed positions, a flow tube telescopically movable in the housing for controlling the movement of the valve closure member, said tube opening the valve closure member on downward movement, means for biasing the flow tube upwardly for allowing the valve closure member to move to the closed position, a variable, radially retractable choke connected to the flow tube and extending into the bore for moving the flow tube downwardly in response to downward fluid injection in the bore, but contracting to allow the passage of well tools through the valve, a no-go shoulder on the flow tube, releasable lockout means between the flow tube and the housing for locking the flow tube and valve in the open position, and an engaging shoulder on the flow tube for moving the flow tube to a released position.

* * * * *